United States Patent [19]

Mead et al.

[11] Patent Number: 4,811,853

[45] Date of Patent: Mar. 14, 1989

[54] COMBINATION CONTAINER AND PLURAL-MODE GARMENT SUPPORT

[75] Inventors: Gary G. Mead, Santa Ana; George M. Foos, Temecula, both of Calif.

[73] Assignee: Spartan Container Corp., Orange, Calif.

[21] Appl. No.: 142,836

[22] Filed: Jan. 6, 1988

[51] Int. Cl.[4] ..... A47F 5/00

[52] U.S. Cl. ..... 211/124; 206/279

[58] Field of Search ..... 211/7, 8, 124; 206/279, 206/289, 290, 291

[56] References Cited

U.S. PATENT DOCUMENTS

| | | | |
|---|---|---|---|
| 2,357,309 | 9/1944 | Brown et al. | 206/7 |
| 2,822,093 | 2/1958 | Graci | 211/124 |
| 3,021,958 | 2/1962 | Winkler | 211/124 |
| 3,112,027 | 11/1963 | Field et al. | 206/7 |
| 3,162,314 | 12/1964 | Belsinger | 211/124 |
| 3,298,503 | 1/1967 | Field et al. | 206/7 |
| 3,306,465 | 2/1967 | Brennan | 211/124 |
| 3,349,923 | 10/1967 | Feder | 211/123 |
| 3,403,787 | 10/1968 | Browning | 211/124 |
| 3,419,154 | 12/1968 | Shapiro et al. | 211/7 |
| 3,458,051 | 7/1969 | Zeman et al. | 211/124 |
| 3,472,385 | 10/1969 | Shapiro et al. | 211/7 |
| 3,519,139 | 7/1970 | Brennan | 211/124 |
| 3,610,427 | 10/1971 | Maziarka et al. | 211/123 |
| 3,633,760 | 1/1972 | Vosbikian | 211/124 |
| 3,993,195 | 11/1976 | Caligiuri | 211/7 |
| 4,139,102 | 2/1979 | Winton | 211/124 |
| 4,204,601 | 5/1980 | Thomas | 211/4 |
| 4,293,076 | 10/1981 | Collin | 211/124 |
| 4,300,690 | 11/1981 | Thomas | 211/4 |
| 4,340,145 | 7/1982 | Cameron | 211/124 |
| 4,396,124 | 8/1983 | Feder | 211/124 |
| 4,496,060 | 1/1985 | Anderson et al. | 211/124 |

*Primary Examiner*—Robert W. Gibson, Jr.
*Attorney, Agent, or Firm*—Richard L. Gausewitz

[57] ABSTRACT

A combination shipping container and garment support. The shipping container is adapted to have garments hung in it while the garments are supported on garment hangers. A hanger bar assembly is mounted in the container, and supports at least several of the hangers. The hanger bar assembly has end holders mounted on opposed walls of the shipping container, and a hanger bar extended between the end holders. The hold-down bar holds the hangers on the hanger bar, being pivotally mounted on the hanger bar at a location intermediate the end holders. The ends of the hold-down bar are held in the end holders when the hold-down is in a position substantially parallel to the hanger bar.

12 Claims, 2 Drawing Sheets

FIG. 3.
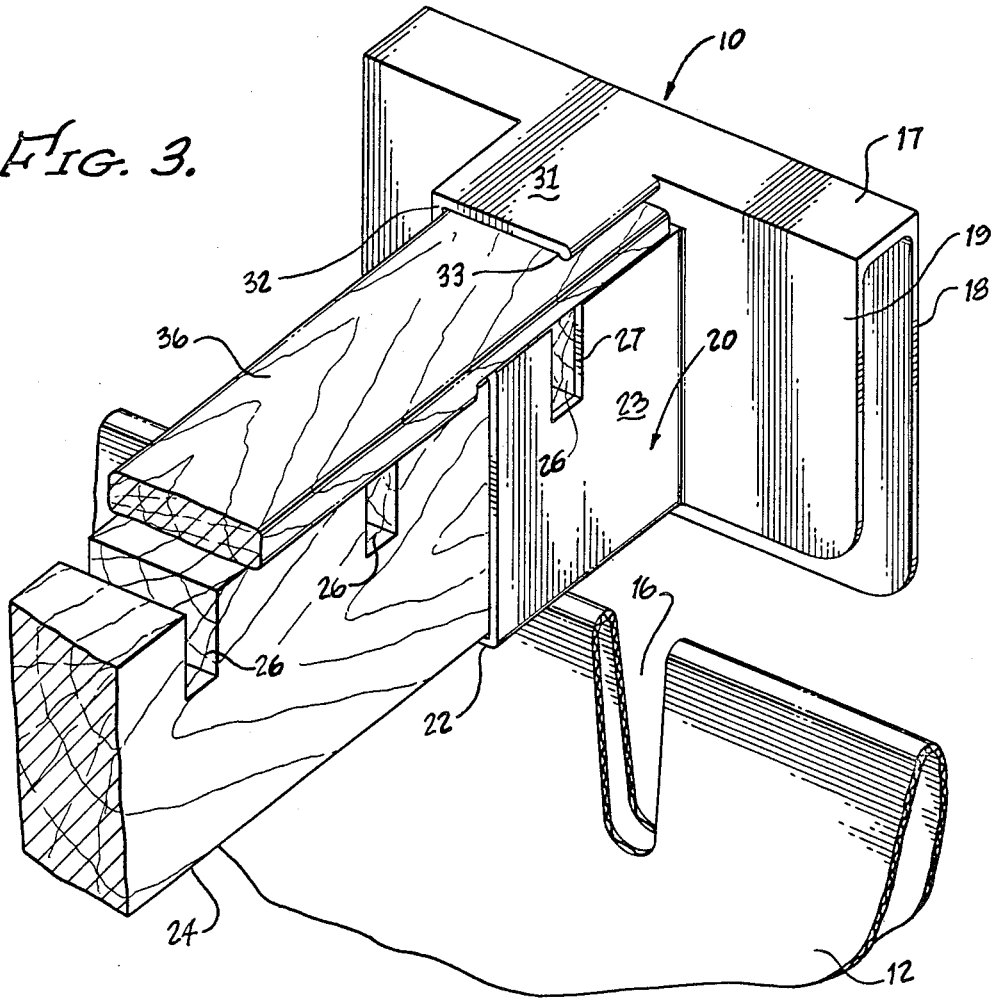
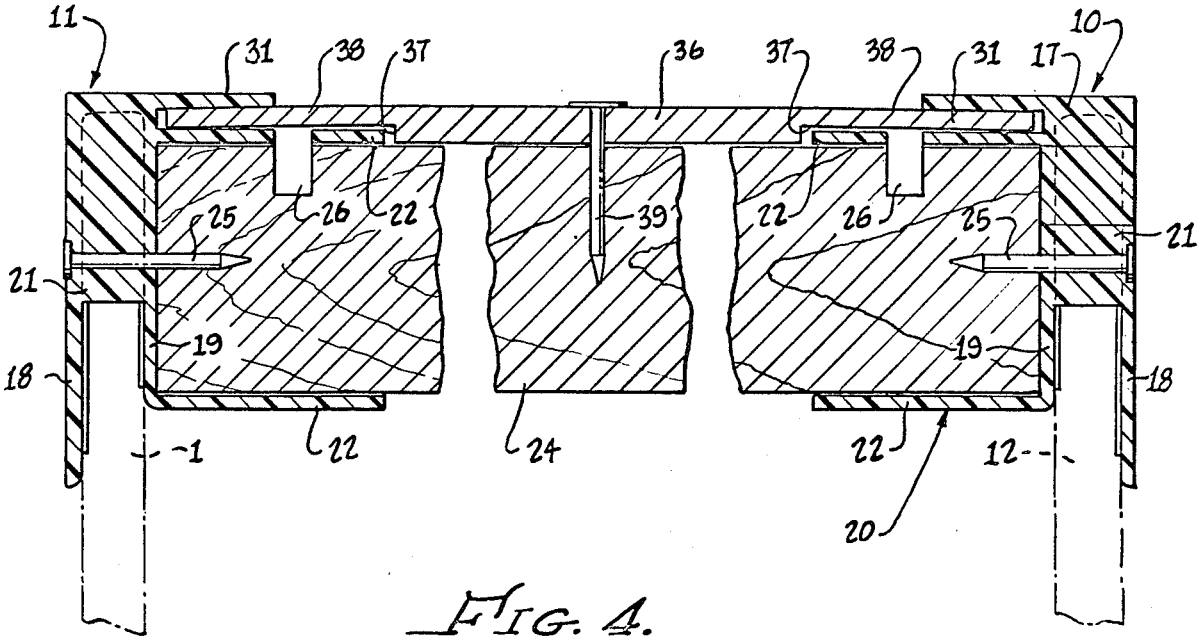
FIG. 4.

COMBINATION CONTAINER AND PLURAL-MODE GARMENT SUPPORT

BACKGROUND OF THE INVENTION

Because the hanger bar assemblies used in supporting suits and other garments during transportation from ports to stores are conventionally used only once and then discarded, it is highly important that such assemblies be very economical to build. On the other hand, the hanger bars and associated components must be strong and effective—must not let the garments shift out of position despite the shocks, tipping over, etc., inherent in transportation. Also, and very importantly, the hanger bars must be such that loading of the shipping containers is facilitated.

There is a distinct need for a combination container and hanger bar assembly that is economical, strong and effective, and that can be used in different ways during container-loading operations Different container-loading companies may have different preferences relative to the most efficient manner of loading the shipping containers with clothing. It is highly desirable that a single hanger bar assembly can be employed in different ways without the use of any additional or different parts whatever, without increased manufacturing costs, and without use of different types of parts such as are common in prior-art patents in the field.

SUMMARY OF THE INVENTION

Applicants have conceived and developed a combination container and plural-mode hanger bar assembly that is economical to manufacture yet fulfills all requirements for effectively supporting garments in the desired positions in their container. Furthermore, the present combination is extremely easy to employ, and can be employed in different ways as desired by the container loader.

Two end holders are provided, being preferably injection molded of synthetic resin using only a single shape of molding cavity. Two of the end holders receive, in sockets, opposite ends of the hanger bar. They also receive, in side-access groove means, opposite ends of a hold-down bar that is provided in a horizontal plane immediately above the hanger bar. The side-access groove means open in opposite directions, so that when the hold-down bar is pivoted about a fulcrum located at the center of the hanger bar the two ends of the hold-down bar will be received in and held in the groove means.

The fulcrum for the hold-down bar is preferably a nail, and performs different functions. In addition to acting as the fulcrum, it holds down the center of the hold-down bar so that even substantial forces acting on the underside of such bar will not cause it to bow upwardly.

When the present combination is used by a person loading the container, he or she merely drops the end holders over opposed sides of the container at notches at the upper edges of such sides. Then, the hold-down bar is pivoted about its nail so as to provide full access to one side of the container. After such one side is loaded, the hold-down bar is pivoted to provide full access to the other side of the container. After both sides are thus loaded, the ends of the hanger bar are snapped into their groove means and held therein.

Alternatively, the nail in the hold-down bar is not driven at the factory. Instead, the hold-down bar and the hanger bar are provided with pre-punched undersized nail holes in registry with each other. Then, the loader mounts the garments on the hanger bar, following which he or she snaps the ends of the hold-down bar in the side-access grooves, and then drives the nail into the pre-formed holes.

The upper side of the hanger bar has individual notches in it for the individual garment hangers. In the event that any hook portion of any garment hanger moves up into the region between hanger and hold-down bars, the central nail assures that such hanger will remain on its original side of the shipping container.

BRIEF DESCRIPTION OF THE DRAWINGS

FIG. 3 is an enlarged isometric view corresponding to the right end of the hanger bar assembly shown in FIG. 2, but showing the end holders spaced above the upper edge of the container; and FIG. 4 is a longitudinal sectional view illustrating the hanger bar assembly as associated with a container, the container being indicated in phantom, and illustrating the hold-down bar in hold-down position.

DETAILED DESCRIPTION OF THE PREFERRED EMBODIMENT

Figure 1:
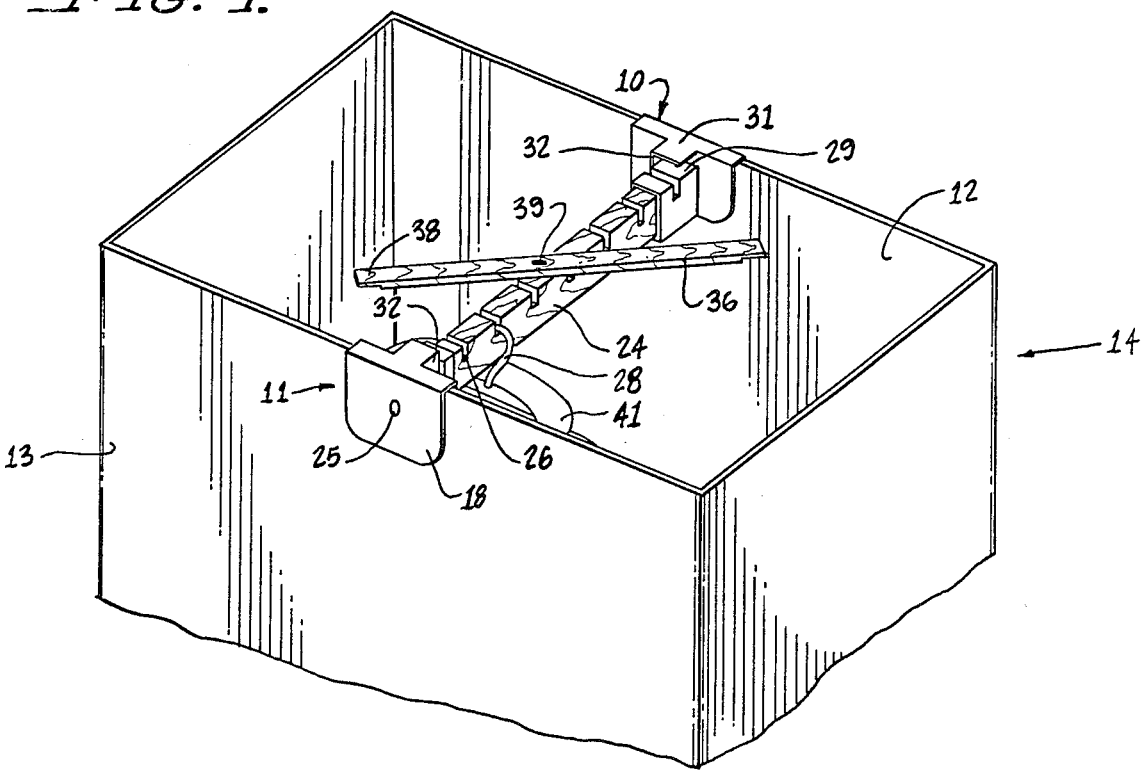
FIG. 1 is an isometric view illustrating the present combination, in position for one manner of loading garments.

Referring to the drawings, there are two end holders 10,11 that are identical to each other; thus, only one (number 10) will be described in detail. Each of the identical end holders 10,11 is preferably an integral synthetic-resin element formed by injection molding. The end holders are adapted to be mounted at the upper edges of opposed sides 12,13 of a shipping container 14 preferably formed of corrugated cardboard.

The upper region of each side 12,13 is double-walled as indicated in FIG. 3, and is provided with a central notch 16. Such notch not only locates the end holders 10,11 during the carton-loading operation, but also holds the end holders against sliding along the container edges.

End holder 10 (which, is above stated, is identical in all respects to end holder 11) has a channel-shaped base the web 17 of which is horizontal and is supported on the upper edge of container side 12. The channel has an outer flange 18 and inner flange 19 that are parallel to each other, and that fit adjacent the outer and inner sides of container wall 12. Extending between flanges 18,19 is a locating portion 21 (FIG. 4) shaped to fit snugly in notch 16 and thus maintain the end holder 10 in its desired centered position on container side 12. Such locating portion is molded integrally with the remainder of end holder 10.

A socket 20 is molded integrally with inner flange 19, in downwardly-spaced relationship from web 17. The socket is rectangular in vertical section (such section being taken in a plane parallel to flange 19), having upper and lower horizontal walls 22 and opposed vertical walls 23.

The socket 20 formed by walls 22,23 is sized to receive snugly an end of hanger bar 24. Such bar is preferably formed of wood and is rectangular in vertical transverse section, having a substantially larger vertical dimension than horizontal dimension in such section. A nail 25 is extended inwardly through a molded passage in flanges 18,19, as well as in locating portion 21, and driven into the end of the hanger bar 24.

Provided in equally-spaced relationship along the upper edge of hanger bar 24 are a plurality of notches 26. Each such notch is adapted to receive the hook portion 28 of the coat hangers on which suits or other garments are hung. The endmost notches 26 register with notches 27 formed in the upper horizontal socket wall 22 and in the adjacent regions of vertical walls 23 of the socket. Thus, the present assembly provides for additional hanger hooks at the socket portions 20 of end holders 10,11.

A side-entry slot 29 is formed in end holder 10 above the socket portion 20 thereof, reference being made to FIG. 1. Slot 29 is formed by a horizontal wall 31 that is preferably flush with web 17, and spaced above the upper horizontal socket wall 22. At one edge of wall 31, the left edge thereof as viewed in FIGS. 1 and 3, there is a vertical wall 32 which forms the "bottom" of the slot 29 and acts as a stop limiting rotation of the hold-down bar. At its other edge, the right edge as viewed in FIGS. 1 and 3, horizontal wall 31 is provided with a downwardly-protruding bead 33 (FIG. 3). Such bead 33 extends below the bottom surface of wall 31 and applies localized pressure to the upper surface of the hold-down bar to thus retain such bar in the slot 29.

The hold-down bar is numbered 36. It is rectangular in transverse section, with the longer axis of the section being horizontal and the shorter axis vertical. The bar 36 overlies the upper horizontal surface of hanger bar 24 and is preferably in sliding contact therewith except at the sockets 20 of the end holders 10.

Hold-down bar 36 is in substantially the same plane as the upper edges of container 14. The hold-down bar 36 pivots generally in said plane, about an axis perpendicular to said plane and is substantially midway between the end holders.

At each end of hold-down bar 36, a notch or rabbet 37 is formed, from a region outwardly adjacent the inner end of upper horizontal wall 22 of each socket. Accordingly, there is formed a tongue 38 at each end of hold-down bar 36, and each such tongue extends over the upper horizontal wall 22 of the associated socket and into the side-entry slot 29. The bead 37 applies downward pressure on such tongue 38, compressing the tongue between the bead and the upper horizontal socket wall 22 (FIGS. 3 and 4).

At the center of hold-down bar 36, and of hanger bar 24, there is provided a vertical nail 39. Such nail serves as a fulcrum or axis for pivotal movement of hold-down bar 36 in a horizontal plane. Furthermore, the head of the nail prevents the central region of bar 36 from bowing upwardly in response to pressure exerted by the hanger hooks 28 when, for example, a container 14 is negligently caused to be upside-down while being shipped. Furthermore, nail 39 insures that no hook portion 28 may shift along hanger bar 24 from one side of the container 14 (for example, the upper-right side as shown in FIG. 1) to the other side of the container (for example, the lower-left side as shown in FIG. 1).

Methods of Operation

In accordance with the first method of operation, the hold-down bar 36 is initially fully assembled to hanger bar 24, nail 39 being driven through such bars as shown in FIG. 4.

Figure 2:
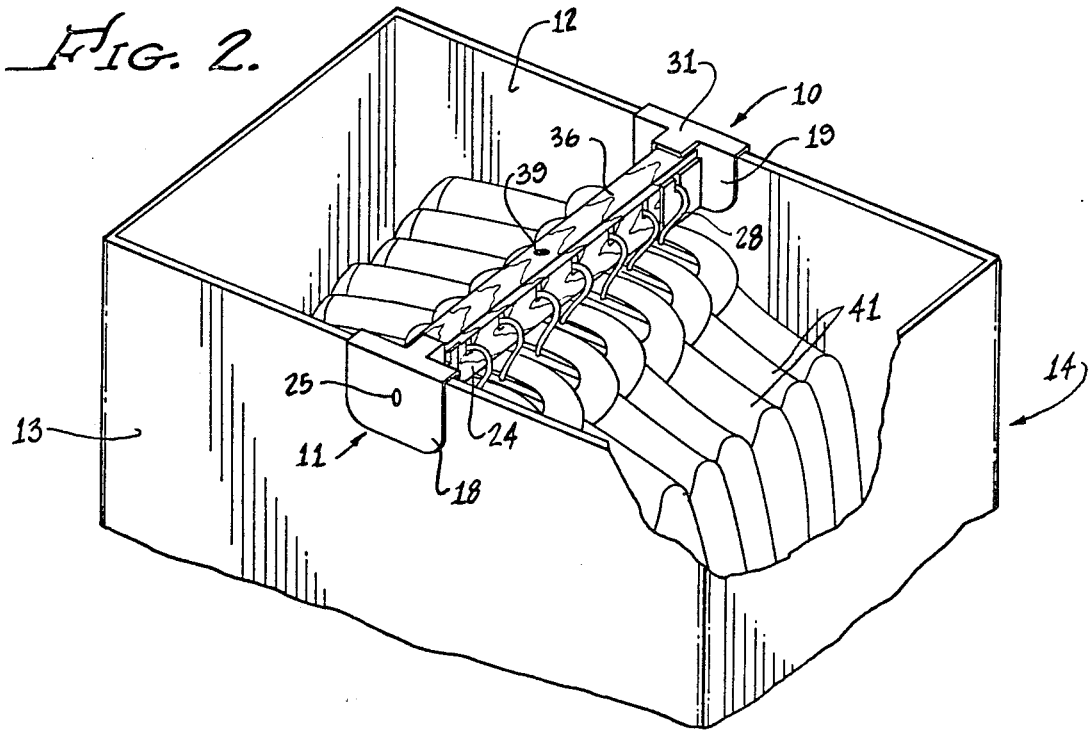
FIG. 2 corresponds to FIG. 1 but shows the container fully loaded, and shows the hold-down bar in its garment-securing position.

After the container has been set up at the loading site, the hanger and hold-down assembly is mounted in the upper portion of the container, with the notches 16 (FIG. 3) in the container locating the end holders 10,11. It is pointed out that, because the end holders 10,11 are identical to each other, and because the socket portions 20 of such end holders both face inwardly, the side-entry slots (one of which is shown at 29 at the right portion of FIG. 1) face in opposite directions. Thus, such slot shown at the right in FIG. 1 is entered from the right side, while the identical slot (unshown) in end holder 11 is entered from its left side as viewed in FIG. 1. Stated otherwise, the vertical slot walls 32 are on opposite sides when the end holders 10,11 are in the facing positions shown in FIGS. 1 and 2.

The loader then pivots the hold-down bar 36 clockwise (as viewed from above), for example, to the position shown in FIG. 1. This means that a loader standing on the right side of the container (FIG. 1) has relatively free access to that portion of the container between nail 39 and end holder 11. The loader therefore loads suits 41 or other garments in those slots 26 between nail 39 and the channel portion of end holder 11.

Thereafter, hold-down bar 36 is pivoted clockwise approximately 90°, so that a loader standing on the right side of the container (FIG. 1) has relatively free access to the container region between nail 39 and end holder 10. Then, the hooks 28 of the hangers for the remaining suits 41 are placed in the slots 26 between nail 39 and the channel portion of end holder 10.

Then, the hold-down bar 36 is pivoted counterclockwise to cause the tongues 38 to enter the side-entry slots 29 in both end holders 10,11, where the tongues remain due to the pressure exerted by beads 33 one of which is shown in FIG. 3.

Thus, the hold-down bar 36 is effectively held closely adjacent both hanger bar 24 and the socket portions of end holders 10,11, due to the presence of slots 29 and nail 39.

In accordance with a second method of operation, the nail 39 is not driven through the hold-down bar 36 and into the hanger bar 24 at the factory. Instead, there is provided at the factory an undersized hole at the center of the upper portion of hanger bar 24. Furthermore, the nail 39 is either driven through the center of the hold-down bar 36, or alternatively, a relatively large hole is provided at the center of such bar 36 to freely receive the nail 39.

Then, at the loading site, the hold-down bar 36 (which had been conveniently shipped with the hanger bar and end holders by being held part way in slots 29) is not present. The upper end of the container 14 is freely accessible to the loader.

After all of the slots have been filled with the hook portions of the hangers for suits or other garments 41, the operator passes the nail 39 through hold-down bar 36 (if it is not already therethrough), places the point of the nail 39 at the previously-formed undersized hole in the center of the upper region of hanger bar 24, and drives the nail into such bar.

The above is done, in one form, when the hold-down bar is slightly oblique to hanger bar 24 so that no portion of the hold-down bar is in a side-entry slot 29. After the nail is driven, the hold-down bar 36 is pivoted to cause the tongues 38 to enter the side-entry slots 39 and be held therein by beads 33.

In another form of the method, the hold-down bar 36 is, after the suits or other garments have been loaded, caused to be present in both side-entry slots 29. Then, the nail 39 is inserted through the thus-mounted hold-down bar 36 and driven into hanger bar 24.

After loading of the container 14, a cover (not shown) is provided on such container 14. Such cover not only completes the enclosure for the suits 41, but operates to maintain the end holders 10,11 in their illustrated positions at which the container edges are fully received therein.

The foregoing detailed description is to be clearly understood as given by way of illustration and example only, the spirit and scope of this invention being limited solely by the appended claims.

What is claimed is:

1. A combination shipping container and garment support, comprising:

(a) a shipping container adapted to have garments hung therein while said garments are supported on garment hangers, and (b) a hanger bar assembly mounted in said container for support of at least several of said hangers and thus the garments thereon, said hanger bar assembly comprising:

(1) first and second end holders mounted on opposed walls of said shipping container, (2) a hanger bar extended between said end holders and supported thereby, said hanger bar being adapted to support at least several of said garment hangers, (3) a hold-down bar to hold said hangers on said hanger bar, (4) means to pivotally mount said hold-down bar on said hanger bar at a location intermediate said end holders, and (5) means to hold the ends of said hold-down bar when said hold-down bar is in a position substantially parallel to said hanger bar.

2. The invention as claimed in claim 1, in which said means to pivotally mount said hold-down bar on said hanger bar further operates to hold said hold-down bar adjacent said hanger bar at a region substantially midway between said end holders, despite any forces exerted by said hangers tending to bow said hold-down-bar region away from said hanger bar.

3. The invention as claimed in claim 1, in which said end holders are mounted adjacent the upper edge regions of said opposed walls of said shipping container, and in which said end holders, said hold-down bar, and said pivotal mounting means are such that said hold-down bar pivots in generally the same plane as that of said upper edge regions, about a pivot axis that is perpendicular to said plane and is substantially midway between said end holders, and in which said hanger bar is on the side of said hold-down bar remote from said plane.

4. The invention as claimed in claim 1, in which said means to hold the ends of said hold-down bar when said hold-down bar is in a position substantially parallel to said hanger bar comprises means to define side-entry grooves respectively adapted to receive the opposite ends of said hold-down bar when said hold-down bar is substantially parallel to said hanger bar.

5. The invention as claimed in claim 1, in which said end holders are identical to each other, and are mounted on the upper edges of said container in facing relationship relative to each other, and in which said means to hold the ends of said hold-down bar when said hold-down bar is in a position substantially parallel to said hanger bar comprises means on said end holders to define side-entry grooves, the mouths of said grooves facing in opposite directions relative to each other when said end holders are thus mounted in facing relationship, said mouths receiving the opposite ends of said hold-down bar as said hold-down bar is pivoted from a position transverse to said hanger bar to a position substantially parallel thereto.

6. The invention as claimed in claim 3, in which said end holders are identical to each other, and are mounted on the upper edges of said container in facing relationship relative to each other, and in which said means to hold the ends of said hold-down bar when said hold-down bar is in a position substantially parallel to said hanger bar comprises means on said end holders to define side-entry grooves, the mouths of said grooves facing in opposite directions relative to each other when said end holders are thus mounted in facing relationship, said mouths receiving the opposite ends of said hold-down bar as said hold-down bar is pivoted from a position transverse to said hanger bar to a position substantially parallel thereto.

7. A hanger bar assembly for combination with a shipping container, the combination to be employed in the transporting of garments hung on hangers, said hanger bar assembly comprising:

(a) first and second end holders, (1) each of said end holders including an inverted channel one flange of which is adapted to be near the outer side of the upper edge portion at one wall of a shipping container, and the other flange of which is adapted to be near the inner side of said upper edge portion of said one wall, (2) each of said end holders having a socket portion adapted to receive one end of a hanger bar, (3) each of said end holders having means to define a side-entry groove, said groove-defining means being above said socket portion when said hanger bar assembly is in mounted condition on an upright shipping container, (b) a hanger bar extended between said end holders, (1) the ends of said hanger bar being inserted into said socket portions, and (c) a hold-down bar extended between said end holders, (1) the ends of said hold-down bar being disposed in said side-entry grooves of said means to define a side-entry groove in each of said end holders, (2) said hold-down bar being above and adjacent said hanger bar when said hanger bar assembly is in mounted condition on an upright shipping container.

8. The invention as claimed in claim 7, in which each of said end holders is injection molded of synthetic resin.

9. The invention as claimed in claim 7, in which means are provided to pivotally mount said hold-down bar on said hanger bar.

10. The invention as claimed in claim 9, in which said pivotal mounting means further operates to hold the midportion of said hold-down bar near said hanger bar despite stresses resulting from such factors as inverting of the shipping container.

11. The invention as claimed in claim 7, in which the upper sides of said hold-down bar, and of said socket portions of said first and second end holders, are notched to receive hook portions of hangers.

12. The invention as claimed in claim 7, in which said hanger bar assembly is combined with a shipping container, said flanges of said inverted channels being mounted over edge portions of opposed walls of said shipping container, said hanger bar and said hold-down bar extending across an opening in said shipping container between said edge portions.

* * * * *